US005096057A

United States Patent [19]

Yoo

[11] Patent Number: 5,096,057

[45] Date of Patent: Mar. 17, 1992

[54] COMBINATION MATCH-CIGARETTE CONTAINER

[76] Inventor: Yeung J. Yoo, 2-102, Hanyang Apt., Sanggye 2-Dong, Nowon-gu, Seoul, Rep. of Korea

[21] Appl. No.: 660,055

[22] Filed: Feb. 25, 1991

[30] Foreign Application Priority Data

Dec. 4, 1990 [KR] Rep. of Korea ..... 90-19811

[51] Int. Cl.[5] ..... B65D 85/10

[52] U.S. Cl. ..... 206/90; 206/85

[58] Field of Search ..... 206/85, 86, 90–95

[56] References Cited

U.S. PATENT DOCUMENTS

| | | | |
|---|---|---|---|
| 600,615 | 3/1898 | Holmes | 206/94 |
| 1,970,878 | 8/1934 | Anderson | 206/94 |
| 2,418,658 | 4/1947 | Nethercutt | 206/94 |
| 2,891,712 | 6/1959 | Ford et al. | 206/93 |
| 2,975,890 | 3/1961 | Block | 206/94 |
| 3,509,989 | 5/1970 | Woll | 206/94 |

FOREIGN PATENT DOCUMENTS

| | | | |
|---|---|---|---|
| 0075261 | 11/1917 | Switzerland | 206/93 |

*Primary Examiner*—Jimmy G. Foster
*Attorney, Agent, or Firm*—Foley & Lardner

[57] ABSTRACT

An integral match-cigarette case constructed in such a way that a match part is integrally formed with a cigarette case is disclosed. The integral match-cigarette case comprises a body having a base part. A pair of first side parts extend from the base part, and is folded to a right angle relative to the base part. A first cover part extends from one of the first side parts, and is folded to be secured to the other of the first side parts to form an open-ended chamber. The first cover part further includes a match part having a plurality of match stick coated with an igniting substance. A bottom part including a pair of bottom reinforcing parts forms a bottom of the chamber to enable storage of a plurality of cigarette therein. A second cover part having a friction surface covers the first cover part, such that in use upon grasping and withdrawing the match stick the igniting substance engages the friction surface to ignite the match stick. A pair of second side parts cover the side parts.

11 Claims, 4 Drawing Sheets

COMBINATION MATCH-CIGARETTE CONTAINER

BACKGROUND OF THE INVENTION

1. Field of the Invention

The invention relates to an integral match-cigarette case, and more particularly, to an integral match-cigarette case constructed in such a way that a pack of matches is integrally formed with a cigarette case in which a plurality of cigarettes are stored thereby providing the user of the cigarettes not only with a means to store the cigarette but also with a means to light the cigarette in the same container.

2. Background Information

Generally, a person who smokes has to carry a separate igniting means such as a match or lighter, in addition to the package storing or holding the cigarette. However, it is inconvenient for one to carry a match, lighter, or the like in addition to the package of cigarettes. This is especially so in the summer or in those situations where the clothing fails to provide sufficient pockets. Also there are those of us who are inclined to misplace the separate igniting means.

Presently disposable gas lighters are used which presents a disposable problem in that land fills are being depleted and residual gas may remain to further pollute the environment. Such lighters are also dangerous in that they may explode during normal use.

Accordingly, to solve the aforementioned problems, an invention described in Korean U.M. Registration No. 90-53204, by the same inventor, Yeung Joon, Yoo, on Dec. 1, 1990 has been presented. In this application, a match case is constructed to be attached to a cigarette case so that the cigarette can be readily lit, and the match case can be disposed easily with the cigarette case after use. However, although the match case has an inherent advantage in that it can be easily attached to a cigarette case or a pulse, it requires a rather complex method for manufacturing.

Therefore, an object of the present invention is to provide an integral match-cigarette case constructed in such a way that a plurality of matches is integrally formed with the cigarette case for storing the plurality of cigarettes.

It is a further object of the present invention to provide an integral match-cigarette case design which decreases the number of steps to manufacture the case.

It is a further object of the present invention to provide an integral match-cigarette case which is very economical to manufacture.

It is a further object of the present invention to provide an integral match-cigarette case which may be manufactured with biodegradable materials.

It is a further object of the present invention to provide an integral match-cigarette case which is easy to use.

An advantage of the present invention is the easy of manufacturing the integral match-cigarette case by utilizing a single sheet to form a separate storage containers for the matches and for the cigarettes.

The preceding objects should be construed as merely presenting a few of the more pertinent features and applications of the invention. Many other beneficial results can be obtained by applying the disclosed invention in a different manner or modifying the invention within the scope of the disclosure. Accordingly, other objects and a fuller understanding of the invention may be had by referring to both the summary of the invention and the detailed description, below, which describe the preferred embodiment in addition to the scope of the invention defined by the claims considered in conjunction with the accompanying drawings.

SUMMARY OF THE INVENTION

An integral match-cigarette case of the present invention is defined by the claims with a specific embodiment shown in the attached drawings. For the purpose of summarizing the invention, the invention relates to an integral match-cigarette case which comprises a body having a base part with a first side part, of a pair of first side parts, extending from opposite sides of the base part. Preferably the base part has four sides, i.e. a top, bottom, left and right sides. In most cases the base part is of a rectangular shape in order to accommodate the number and length of the cigarettes. The first side parts are separated from the base part by fold lines, respectively. A first cover part extends from one of the pair of first side parts with a fold line separating the first cover part and the first side part. For purposes of illustration, the first cover part extends from first side part with a fold line separating the first cover part and the first side part. The first cover part terminates in a first attaching part which is separated from the first cover part by a fold line. The first attaching part secures, by an attaching means such as glue, in use, the first cover part to the other of the pair of first side part, thereby forming an open-ended chamber. Fold lines are parallel, or substantially parallel, relative to one another to permit the folding of the body into the open-ended chamber. The first cover part further includes a match part having a plurality of match sticks. To enhance the ease of removing each match stick of the plurality of match stick, a terminal end thereof is diagonally and partially cut from the first cover part along a diagonal or inclined cutting line. Preferably, the plurality of match sticks are formed from the thick paper stock, or the like, which comprises the first cover part. The base part further includes a bottom part extending from the base part with the bottom part separated from the base part by a fold line. A second cover part extends from the bottom part of the base part with the second cover part separated from the bottom part by a fold line with the second cover part having a terminal end. The second cover part further includes a pair of second side parts extending from opposite sides of the second cover part. The second side parts are separated from the second cover part by fold lines, respectively. Thus, upon folding along fold lines, the second cover part covers over the first cover part, except for the end portions of each match stick of the plurality of match sticks which extend beyond the terminal end of the second cover part to remain exposed enabling the end portions of each of the plurality of match sticks to be easily grasped, and the second side parts cover over the first side parts, respectively. Simultaneously with folding along lines, the bottom part forms a bottom of the chamber to enable the storage of a plurality of cigarettes therein. Fold lines are parallel, or substantially parallel, relative to one another to permit in use the folding of the second cover part over the first cover part to thereby cover the first cover part except for the end portions of each match stick of the plurality of match sticks and the formation of a bottom of the chamber by bottom part. The second cover part further includes a friction surface. In use, when the second cover part is folded against the first cover part, an opening is formed which contains the matches the friction surface. Thus, in use upon grasping and withdrawing a match stick from the opening, the sulfur portion, i.e. igniting substance, of the match stick engages the friction surface contained in the opening to ignite the igniting substance and ultimately the match stick itself. The chamber and the opening form distinct voids for storing the cigarettes and matches, respectively.

Preferably, the case of the present invention further includes a cap secured to the top end of the base part. The cap forms a top to the chamber, covers and protects the plurality of cigarettes and permits access to the plurality of cigarettes stored within the chamber.

The case of the present invention may further includes an inside reinforcing member, preferably "U" shaped and in intimate contact with the first cover part when the member is positioned in the chamber, to further protect the plurality of cigarettes contained in the chamber from being crushed during the removal of a match stick and to further enhance contact of the sulfur of each the match stick with the friction surface upon grasping and withdrawing a match stick.

Preferably, the case of the present invention wherein each match stick of said plurality of match sticks is separated from an adjacent match stick except a connection part formed at each match stick proximate the end portion of each match stick, such that in use it permits the independent removal of each match stick relative to each adjacent match stick.

The more pertinent and important features of the present invention have been outlined above in order that the detailed description of the invention which follows will be better understood and that the present contribution to the art can be fully appreciated. Additional features of the invention described hereinafter form the subject of the claims of the invention. Those skilled in the art can appreciate that the conception and the specific embodiment disclosed herein may be readily utilized as a basis for modifying or designing other structures for carrying out the same purposes of the present invention. Further, those skilled in the art can realize that such equivalent constructions do not depart from the spirit and scope of the invention as set forth in the claims.

BRIEF DESCRIPTION OF THE DRAWINGS

For fuller understanding of the nature and objects of the invention, reference should be had to the following detailed description taken in conjunction with the accompanying drawings in which.

Similar reference characters refer to similar parts throughout the several views of the drawings.

DETAILED DESCRIPTION OF THE INVENTION

Figure 1:
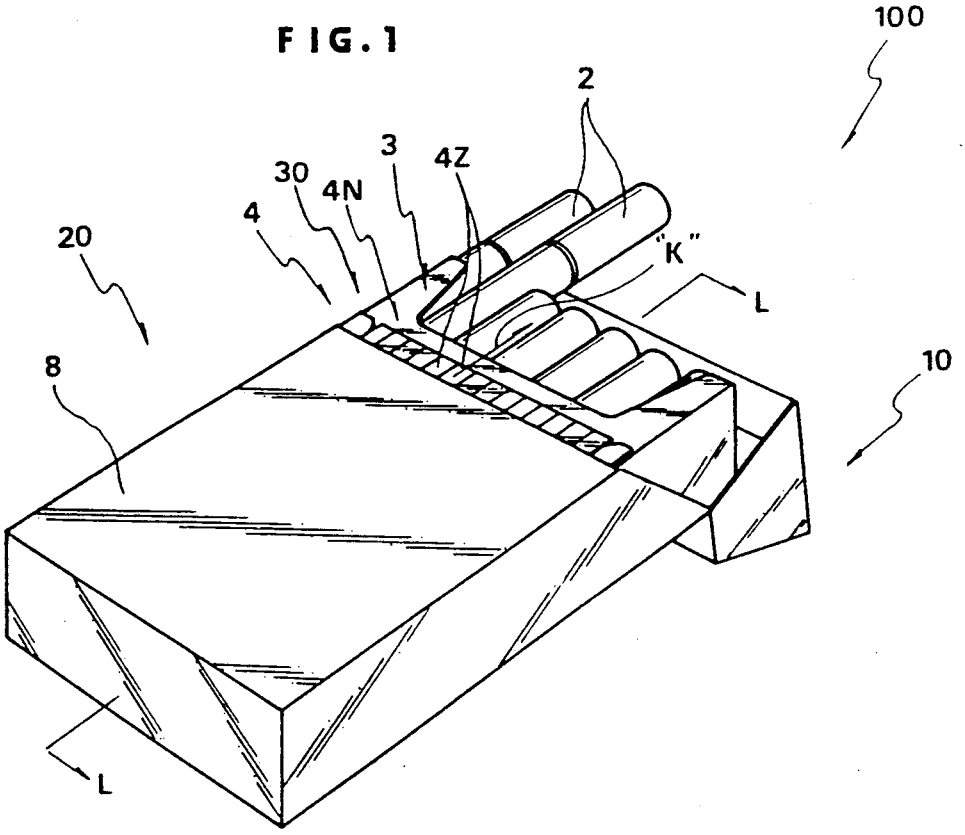
FIG. 1 is a perspective view of a cigarette case of the present invention.

FIG. 1 shows a perspective view of the integral match-cigarette case of the present invention. The cigarette case 100 of the present invention is mainly divided into a cap 10 and a body 20 and is usually made of thick paper or the like. A plurality of cigarette 2 is contained in the body 20, while a match part 4 on which a plurality of match sticks 4N with each match stick coated with sulfur, i.e. an igniting substance, on one end is arranged is integrally formed on the body 20. An inside reinforcing member 3 is inserted into the body 20 for additional protection of the plurality of cigarettes from the ignition of the sulfur which ignites upon withdrawing the match stick 4Z of the match part 4 from the opening 30. When the respective match stick 4Z is pulled in the direction of an arrow K for the purpose of igniting the match, the friction surface 7 formed on the inner upper part 7S of the second cover part 8, see FIG. 3, and the sulfur of the match frictionally engages to result in the ignition of the sulfur and ultimately the match.

Figure 2:
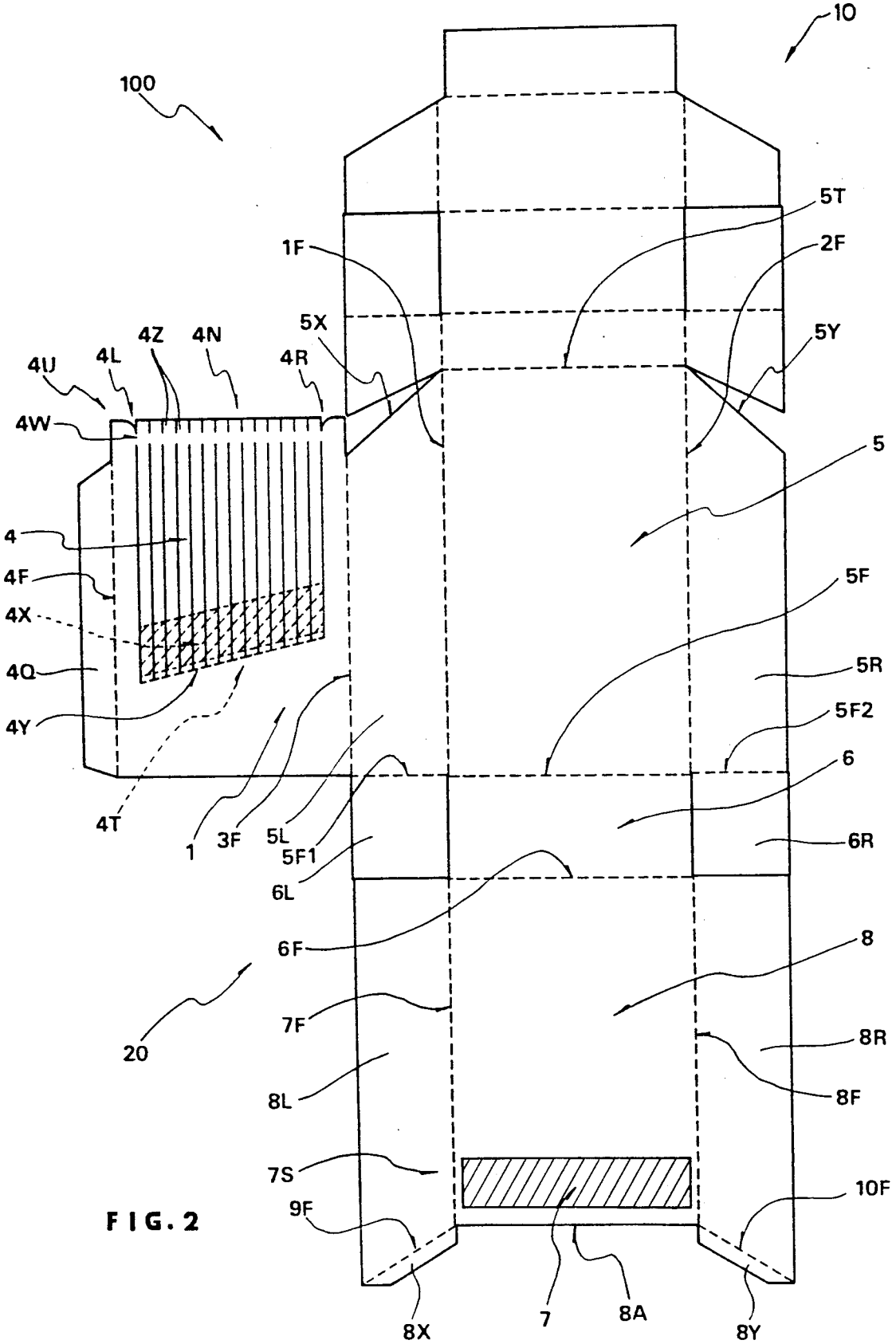
FIG. 2 is an expanded view of a cigarette case of the present invention.

FIG. 2 is an expanded view the integral match-cigarette case of the present invention, illustrating the advantage of that the body 20 may be integrally formed or manufactured with the match part 4, and cap 10 in a single pattern according to the present invention. A detailed explanation of the cap 10 is omitted since the construction thereof it is well known and relatively simple as observed from the figures. Here, it is to be noted that the solid lines in the drawings represent "cut lines" and the dashed lines are folding lines, save for the dashed lines in the match part 4.

A base part 5 extends from the cap 10 by a top end 5T and has a predetermined height and a predetermined width, where the height and the width are established considering the number and the length of the cigarettes to be contained. At both sides of the base part 5 a pair of first side parts 5L, 5R extend outward. The first side parts 5L, 5R have downwardly inclined top ends 5X, 5Y, respectively. The first side parts 5L, 5R are each folded along fold lines 1F and 2F at a right angle relative to the base part 5.

Figure 3:
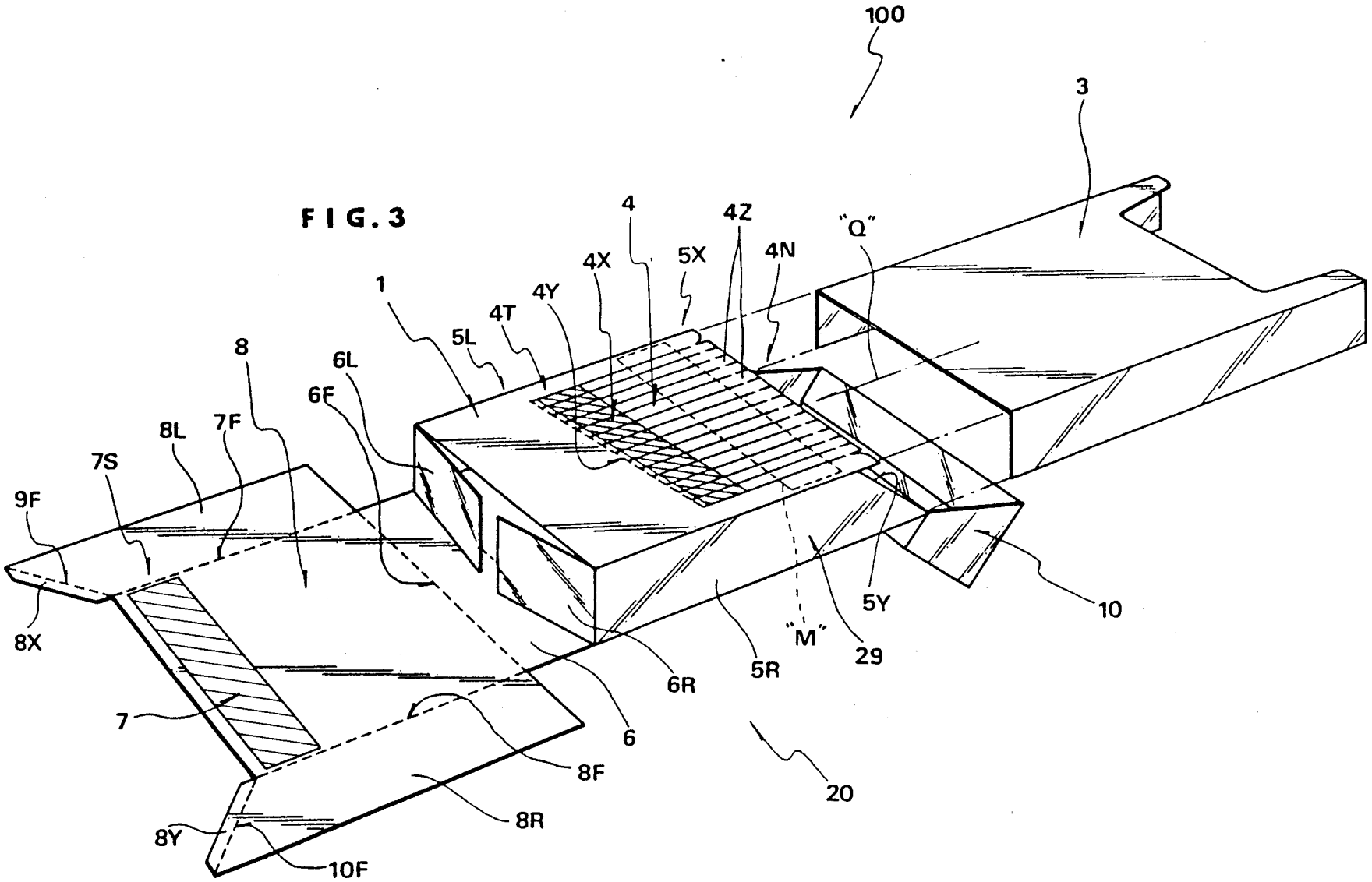
FIG. 3 is an exploded perspective view of a cigarette case of the present invention.

A first cover part extends from one of the pair of first side parts 5L, 5R. For purposes of illustration, the first cover part 1 is also folded along a fold line 3F to a right angle with respect to the first side part 5L. The first attaching part 4Q extends from the first cover part 1 with a fold line 4F separating the first attaching part from the first cover part 1. Thus, when fold lines 1F, 2F, 3F and 4F are folded, first side parts 5L and 5R are spaced apart and parallel to each other and base part 5 and first cover part 1 are also spaced apart and parallel relative to each other, thereby forming an open-ended chamber 29, as shown in FIG. 3. The first attaching part 4Q contacts the first side part 5R, and is secured to the first side part 5R by glue of the like.

The match part 4 is the major technical advantage of the present invention. The match part 4 is, preferably formed from the first cover part 1 and comprises the plurality of match sticks 4N. A terminal end 4T of each match stick 4Z of the plurality of match sticks 4N is coated with an igniting substance, such as sulfur 4X, as shown by oblique dashed lines.

Each match stick 4Z of the plurality of match sticks 4N is separated from an adjacent match stick except at the common connection part 4W at the end portion 4U of the respective match stick 4Z. The reason for utilizing the connection part 4W is to permit the independent removal of each respective match stick 4Z relative to the other match sticks. Further, in the match part 4, recessed parts 4L, 4R are formed at the boundary of the first match stick and the last match stick so that the first and last match stick can be easily separated from the connection part 4W and removed.

Preferably, the terminal end 4T of each match stick of the plurality of match sticks 4N is diagonally cut as illustrated at FIG. 2, whereby the respective match stick 4Z can be easily drawn out in view of the cutting line 4Y of the end of the respective match stick 4Z being diagonal.

To further enhance the ease of removing each match stick, the terminal end 4T of each match stick 4Z is partially cut from the first cover part 1 along a diagonal or inclined cutting line 4Y. In other words, if the respective match stick 4Z is pulled in the direction of arrow K shown in FIG. 1 to light the match, the respective match stick 4Z can be more easily drawn since the cutting line 4 at the terminal end 4T of the respective match stick 4Z is diagonally cut.

Preferably, a pair of bottom reinforcing parts 6L, 6R extends from the lower part of each of the first side parts 5L, 5R with the bottom reinforcing parts 6L, 6R being separated from the first side part 5L, 5R by fold lines 5F1, 5F2, respectively, and not otherwise connected to the body. Bottom reinforcing parts 6L, 6R are folded in the same way as the first side parts 5L, 5R and are folded again at a right angle with respect to the first side part 5L, 5R so as to be in the form as shown FIG. 3.

Referring to FIGS. 2 and 3, the bottom part 6 which extends from the lower part of the base part 5 is folded along a fold line 5F to a right angle with respect to the base part 5. The second cover part 8, which extends from the bottom part 6, is folded along a fold line 6F to a right angle relative to the bottom part 6. These folds enable the second cover part 8 to cover over the first cover part 1, except for a top portion of the match part 4 which extends beyond the terminal end 8A of the second cover part 8.

A friction surface 7 is positioned at the inner upper part 7S of the second cover part 8 proximate the terminal end 8A of the second cover part 8 so that it is positioned at the outer upper part of the match part 4 as shown by a dashed line "M" in FIG. 3 when the second cover part 8 is operatively folded.

Preferably, a pair of second side parts 8L, 8R extend from both sides of the second cover part 8 with the second side parts being separated from the second cover part 8 by fold lines 7F and 8F, respectively. The second side parts 8L, 8R are each folded along fold lines 7F, 8F to a right angle with respect to the second cover part 8 and then secured to the corresponding first side parts 5L, 5R. A pair of second attaching parts 8X, 8Y may optionally extend from the second side parts 8L, 8R proximate the terminal end 8A of the second cover part 8, respectively. The second attaching parts 8X, 8Y are folded along fold lines 9F, 10F with respect to the inclined upper part 5X, 5Y of the first side parts 5L, 5R and attached thereto.

An inside reinforcing member 3 is preferably inserted in the direction of an arrow Q into the body part 20 of the cigarette case 100. The inside reinforcing part 3 protects the cigarettes from being crushed during frictional engagement of the sulfur 4X coated match stick with the friction surface 7, and also supports the respective match stick 4Z when the stick 4Z is forced or pushed against the friction surface 7 in an effort to cause ignition on the match stick 4Z by the user of the case of the present invention upon withdrawing the match.

Figure 4A:
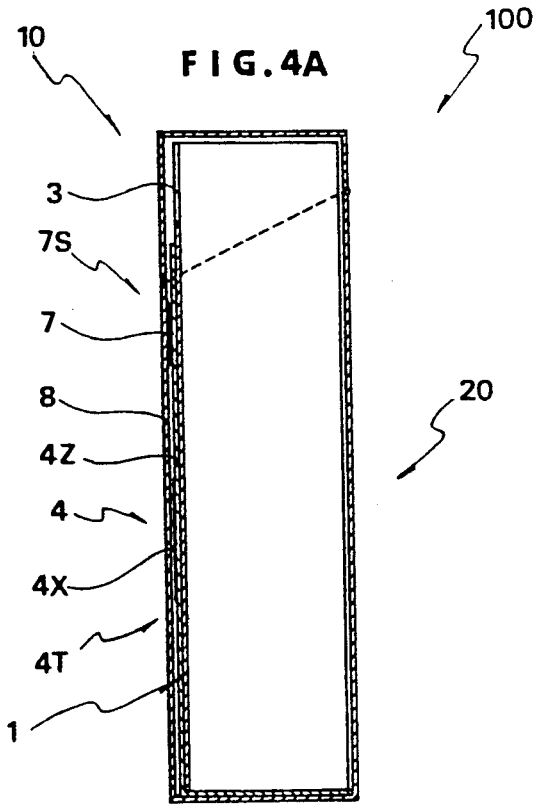
FIG. 4A is a section view taken along the line L—L of FIG. 1.

FIG. 4A is a sectional view of case 100 with the cap 10 in a closed position. The figure is taken along a line L—L of the FIG. 1 and aids in explaining the operation of the present invention. The friction surface 7 is positioned at the inner upper part 7S of the second cover part 8 of the body 20. Each respective match stick 4Z, coated with the sulfur 4X at the terminal end 4T thereof, extends downward a predetermined distance from the friction surface 7 as illustrated. The inside reinforcing part 3 is tightly positioned against the first cover part 1.

Figure 4B:
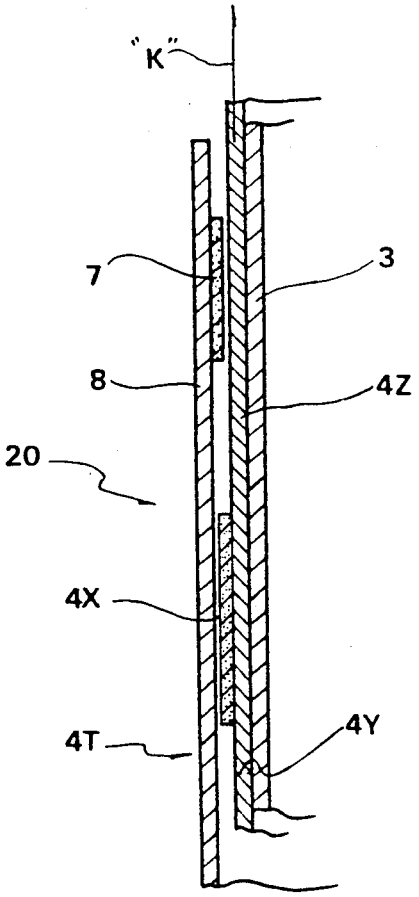
FIG. 4B is a partial enlarged view of FIG. 4A.

FIG. 4B is a partial enlarged view of the FIG. 4A. When the respective match stick 4Z is pulled in the direction of the arrow K, the respective match stick 4Z is torn away from the cutting line 4Y, which partially cuts through the terminal end 4T of each match stick. The sulfur 4X of the respective match stick 4Z then frictionally engages the friction surface 7 of the second cover part 8 to result in the ignition of the sulfur or ignition substance. Because this operation is accomplished in a short time, the complete ignition of the respective match stick 4Z occurs outside of the body part 20 of the match case 100. Hence, there is no or little risk to the user during the withdrawal of the match. Further, since the sulfur 4X and the friction surface 7 are spaced apart relative to each other by a predetermined distance, unintended ignition due to the frictional engagement between the sulfur and the friction surface cannot occur.

Figure 5:
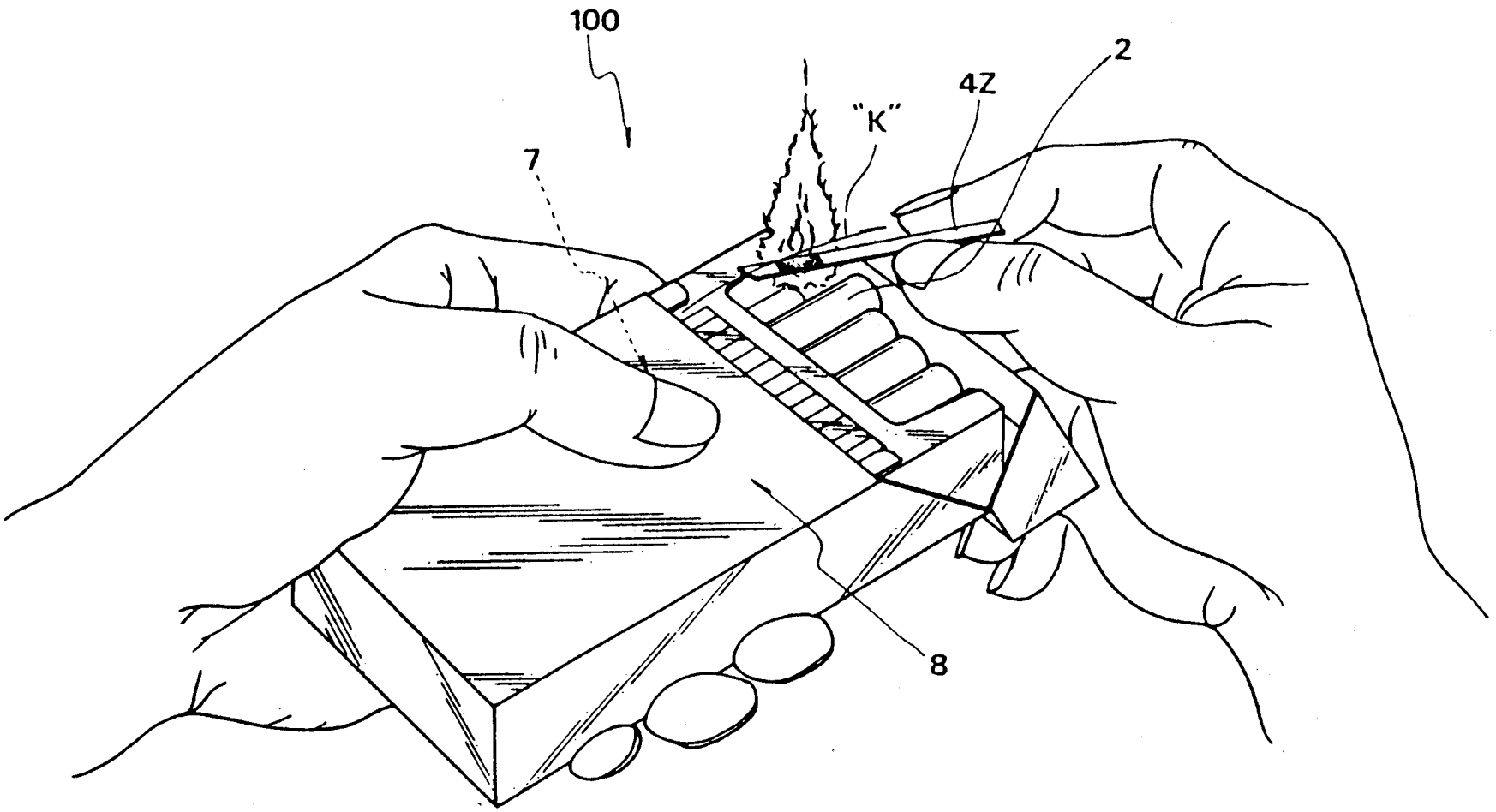
FIG. 5 is a perspective view of a cigarette case of the present invention in the condition of use.

FIG. 5 is a perspective view of the cigarette case of the present invention illustrating the action where the match stick 4Z is being pulled in the direction of the arrow K with by use of one hand while the other hand presses a slightly against the friction surface 7 to enhance frictional engagement to result in the ignition of the match by a single motion.

As described above, according to the present invention, the cigarette case and the match case can be integrally manufactured so that the reduction in the cost and the amount of material used can be obtained.

Although this invention has been described in its preferred form with a certain degree of particularity, it is appreciated by those skilled in the art that the present disclosure of the preferred form has been made only by way of example and that numerous changes in the details of the construction, combination and arrangement of parts may be resorted to without departing from the spirit and scope of the invention.

What is claimed is:

1. An integral match-cigarette case comprising:

a body having a base part with a top end;

a pair of first side parts extending from opposite sides of said base part, with said first side parts folded along fold lines to a right angle relative to said base part, and said first side parts further including top ends which are downwardly inclined, respectively;

a first cover part extending from one of said pair of first side parts, with said first cover part folded along a fold line to a right angle relative to said first side part, and said first cover part further including a match part having a plurality of match stick, with each match stick being coated with an igniting substance proximate its terminal end and having an end portion and a cutting line, with said cutting line being diagonally and partially cut at said terminal end to enhance the ease of removing each said match stick;

a first attaching part extending from said first cover part, with said first attaching part folded along a fold line to a right angle relative to said first cover part for securing said first cover part to the other of said pair of first side parts, when in use, to thereby form an open-ended chamber;

a pair of bottom reinforcing parts extending from opposite sides of said top ends of said first side parts, with said bottom reinforcing parts folded along fold lines to a right angle relative to said first side parts folded with respect to said base part;

a bottom part extending from said base part, with said bottom part folded along a fold line to a right angle relative to said base part to thereby cover over said bottom reinforcing part folded with respect to said first. side parts, such that in use said bottom part forms a bottom of said chamber to enable storage of a plurality of cigarettes therein;

a second cover part extending from said bottom part, with said second cover part folded along a fold line at a right angle relative to said bottom part folded with respect to said base part, to thereby cover over said first cover part except for said end portion of each said match stick of said plurality of match stick to be independently grasped when in use, said second cover part further including an inner upper part and a friction surface positioned at said inner upper part, such that in use upon folding said second cover part said igniting substance and said friction surface are spaced apart relative to each other by a predetermined distance, and such that in use upon grasping and withdrawing said match stick said igniting substance engages said friction surface to ignite said match stick, thereby permitting a cigarette taken from said chamber to be lit;

a pair of second side parts extending from opposite sides of said second cover part, with said second side parts folded along fold lines at a right angle relative to said second cover part to thereby cover over said first side parts; and a pair of second attaching part extending from said second side parts. with said second attaching parts folded along fold lines to said top ends of said first side parts, respectively.

2. The case of claim 1 further including a cap secured to said top end of said base part of said body, which forms a top of said chamber to cover and protect said plurality of cigarettes and permit access to said plurality of cigarettes stored in said chamber.

3. The case of claim 1 further including an inside reinforcing member positioned in said chamber for further protecting said plurality of cigarettes contained in said chamber from being crushed during removal of a match stick and for further enabling when in use enhanced frictional contact of said igniting substance of each said match stick with said friction surface upon grasping and withdrawing a match stick by simultaneously pressing against said friction surface.

4. The case of claim 1 wherein said plurality of match sticks are formed from said first cover part.

5. The case of claim 1 wherein said each match stick of said plurality of match sticks is separated from an adjacent match stick except for a connection part formed at said each match stick proximate said end portion thereof, such that in use it permits the independent removal of said each match stick relative to each said adjacent match stick.

6. An integral match-cigarette case comprising:

a body having a base part with a top end;

a pair of first side parts extending from opposite sides of said base part, with said first side parts folded along fold lines to a right angle relative to said base part, and said first side parts further including top ends which are downwardly inclined, respectively;

a first cover part extending from one of said pair of first side parts, with said first cover part folded along a fold line to a right angle relative to said first side part, and said first cover part further including a match part having a plurality of match stick, with each match stick being coated with an igniting substance proximate its terminal end and having an end portion and a cutting line which is diagonally and partially cut at said terminal end to enhance the ease of removing each said match stick;

a first attaching part extending from said first cover part, with said first attaching part folded along a fold line to a right angle relative to said first cover part for securing, in use, said first cover part to the other of said pair of first side parts to thereby form an open-ended chamber;

a pair of bottom reinforcing parts extending from opposite sides of said top ends of said first side parts, with said bottom reinforcing parts folded along fold lines to a right angle relative to said first side parts folded with respect to said base part;

a bottom part extending from said base part, with said bottom part folded along a fold line to a right angle relative to said base part to thereby cover over said bottom reinforcing part folded with respect to said first side parts, such that in use said bottom part forms a bottom of said chamber to enable storage of a plurality of cigarettes therein;

a second cover part extending from said bottom part, with said second cover part folded along a fold line at a right angle relative to said bottom part folded with respect to said base part, to thereby cover over said first cover part except for said end portion of each said match stick of said plurality of match stick to be independently grasped when in use, said second cover part further including an inner upper part and a friction surface positioned at said inner upper part, such that in use upon folding said second cover part said igniting substance and said friction surface are apart relative to each other by a predetermined distance, and such that in use upon grasping and withdrawing said match stick said igniting substance engages said friction surface to ignite said match stick, thereby permitting a cigarette taken from said chamber to be lit;

a pair of second side parts extending from opposite sides of said second cover part, with said second side parts folded along fold lines at a right angle relative to said second cover part to thereby cover over said first side parts, respectively;

a pair of second attaching part extending from said second side parts, with said second attaching parts folded along fold lines to said top ends of said first side parts, respectively;

an inside reinforcing member positioned in said chamber for further protecting said plurality of cigarettes contained in said chamber from being crushed during removal of said match stick and for further enabling enhanced frictional contact of said igniting substance of each said match stick with said friction surface is use upon grasping and withdrawing a match stick by simultaneously pressing against said friction surface; and a cap secured to said top end of said base part of said body, which forms a top of said chamber to cover and protect said plurality of cigarettes and permit access to aid plurality of cigarettes stored in said chamber.

7. An integral match-cigarette case comprising:

a body including a base part with a pair of first side parts extending from opposite sides of said base part with said first side parts separated from said base part by fold lines, respectively;

a first cover part extending from one of said pair of first side parts with a fold line separating said first cover part which extends from said first side part, and said first cover part terminating in a first attaching part which is separated from said first cover part by a fold line for securing, in use, said first cover part to the other of said pair of first side part and thereby forming an open-ended chamber;

said first cover part further including a match part having a plurality of match sticks with each match stick being coated with an igniting substance;

said base part further including a top end and a bottom part extending from said base part with said bottom part separated from said base part by a fold line such that in use said bottom part forms a bottom of said chamber to enable storage of a plurality of cigarettes therein;

a second cover part extending from said bottom part of said base part with said second cover part separated for said bottom part by a fold line with said second cover part terminating in an end such that in use upon folding said second cover part said first cover part is covered thereby except for an end portion of each match stick of said plurality of match stick to be independently grasped;

said second cover part further including a pair of second side part extending from opposite sides of said second cover part with said second side parts separated from second cover part by fold lines, respectively; and said second cover part further including a friction surface such that in use upon grasping and withdrawing a match stick, said igniting substance on said match stick engages said friction surface to ignite said match stick thereby permitting a cigarette taken from said chamber to be lit.

8. The case of claim 7 further including a cap secured to said top end of said base part of said body, which forms a top of said chamber to cover and protect said plurality of cigarettes and permit access to said plurality of cigarettes stored in said chamber.

9. The case of claim 7 further including an inside reinforcing member positioned in said chamber for further protecting said plurality of cigarettes contained in said chamber from being crushed during removal of a match stick and for further enabling enhanced frictional contact of said igniting substance of each said match stick with said friction surface in use upon grasping and withdrawing a match stick by simultaneously pressing against said friction surface.

10. The case of claim 7 wherein said plurality of match sticks are formed from said first cover part.

11. An integral match-cigarette case comprising:

a body including a base part with a pair of first side parts extending from opposite sides of said base part with said first side parts separated from said base part by fold lines, respectively;

a first cover part extending from one of said pair of first side parts with a fold line separating said first cover part which extends from said first side part, and said first cover part terminating in a first attaching part is separated from said first cover part by a fold line for securing, in use, said first cover part to the other of said pair of first side part and thereby forming an open-ended chamber;

said first cover part further including a match part having a plurality of match sticks with each match stick being coated with an igniting substance;

said base part further including a top end and a bottom part extending from said base part with said bottom part separated from said base part by a fold line such that in use said bottom part forms a bottom of said chamber to enable storage of a plurality of cigarettes therein;

a second cover part extending from said bottom part of said base part with said second cover part separated for said bottom part by a fold line with said second cover part terminating in an end such that in use upon folding said second cover part said first cover part is covered thereby except for an end portion of each match stick of said plurality of match stick to be independently grasped;

said second cover part further including a pair of second side part extending from opposite sides of said second cover part with said second side parts separated from second cover part by fold lines, respectively;

said second cover part further including a friction surface such that in use upon grasping and withdrawing a match stick, said igniting substance on said match stick engages said friction surface to ignite said match stick thereby permitting a cigarette taken from said chamber to be lit;

an inside reinforcing member positioned in said chamber for further protecting said plurality of cigarettes contained in said chamber from being crushed during removal of said match stick and for further enabling enhanced frictional contact of said igniting substance of each said match stick with said friction surface is use upon grasping and withdrawing a match stick by simultaneously pressing against said friction surface; and a cap secured to said top end of said base part which forms a top of said chamber to cover and protect said plurality of cigarettes and permit access to aid plurality of cigarettes stored in said chamber.

* * * * *